US011205320B1

(12) United States Patent
Huke et al.

(10) Patent No.: US 11,205,320 B1
(45) Date of Patent: Dec. 21, 2021

(54) METHOD OF USING PLAYER THIRD PARTY DATA

(71) Applicant: AdrenalineIP, Washington, DC (US)

(72) Inventors: Casey Alexander Huke, Washington, DC (US); Joseph W. Beyers, Saratoga, CA (US); Michael D'Andrea, Burlington, VT (US)

(73) Assignee: AdrenalineIP, Washington, DC (US)

( * ) Notice: Subject to any disclaimer, the term of this patent is extended or adjusted under 35 U.S.C. 154(b) by 0 days.

(21) Appl. No.: 17/071,351

(22) Filed: Oct. 15, 2020

Related U.S. Application Data

(60) Provisional application No. 63/081,553, filed on Sep. 22, 2020.

(51) Int. Cl.
*G07F 17/32* (2006.01)
*G06Q 50/34* (2012.01)

(52) U.S. Cl.
CPC ..... *G07F 17/3227* (2013.01); *G06Q 50/34* (2013.01); *G07F 17/3288* (2013.01)

(58) Field of Classification Search
CPC .. G07F 17/3277; G07F 17/3288; G06Q 50/14
See application file for complete search history.

(56) References Cited

U.S. PATENT DOCUMENTS 9,003,294 B1 * 4/2015 Ames ..... H04L 51/046 715/739
9,870,674 B2 1/2018 Hayon
2014/0274311 A1 * 9/2014 Aronowitz ..... G06Q 30/06 463/25
2016/0133152 A1 * 5/2016 Arif ..... G09B 5/00 434/247
2018/0132758 A1 * 5/2018 Benford ..... A61B 5/1038
2019/0295382 A1 * 9/2019 Huke ..... G07F 17/3276
2020/0133452 A1 * 4/2020 Gupta ..... G06N 5/04

OTHER PUBLICATIONS

Felsen, et al., "Where Will They Go? Predicting Fine-Grained Adversarial Multi-Agent Motion using Conditional Variational Autoencoders", Proceedings of the European Conference on Computer Vision (ECCV), 2018, pp. 732-747; 16 pages.

* cited by examiner

*Primary Examiner* — Corbett B Coburn
(74) *Attorney, Agent, or Firm* — Maier & Maier, PLLC

(57) ABSTRACT

A system to provide the user of an in play wagering system with access to third party data analytics services and integrates the user's selection of available data analytics with the display of a live sporting event and the wagers available on a given play in the sporting event.

13 Claims, 3 Drawing Sheets

| | | | | | Available Subscriptions | | |
|---|---|---|---|---|---|---|---|
| User ID | Device ID | Wager History | Wallet Balance | Display Preferences | Analytics Service 1 | Analytics Service 2 | Analytics Service 3 |
| Joe Smith | 1234 | JSWH.dat | $500 | Analytics 1/Player Overlay | X | | |
| Robert Jones | 2345 | RJWH.dat | $1,250 | Analytics 2/Bottom Ribbon | | X | |
| Susan Rice | 3456 | SRWH.dat | $10 | Analytics 3/Player Overlay<br>Analytics 2/Top Ribbon | | X | X |
| | ... | | | | | | |
| Mike Baker | 8791 | MBWH.dat | $200 | No overlay | X | X | X |

User Database Data Content

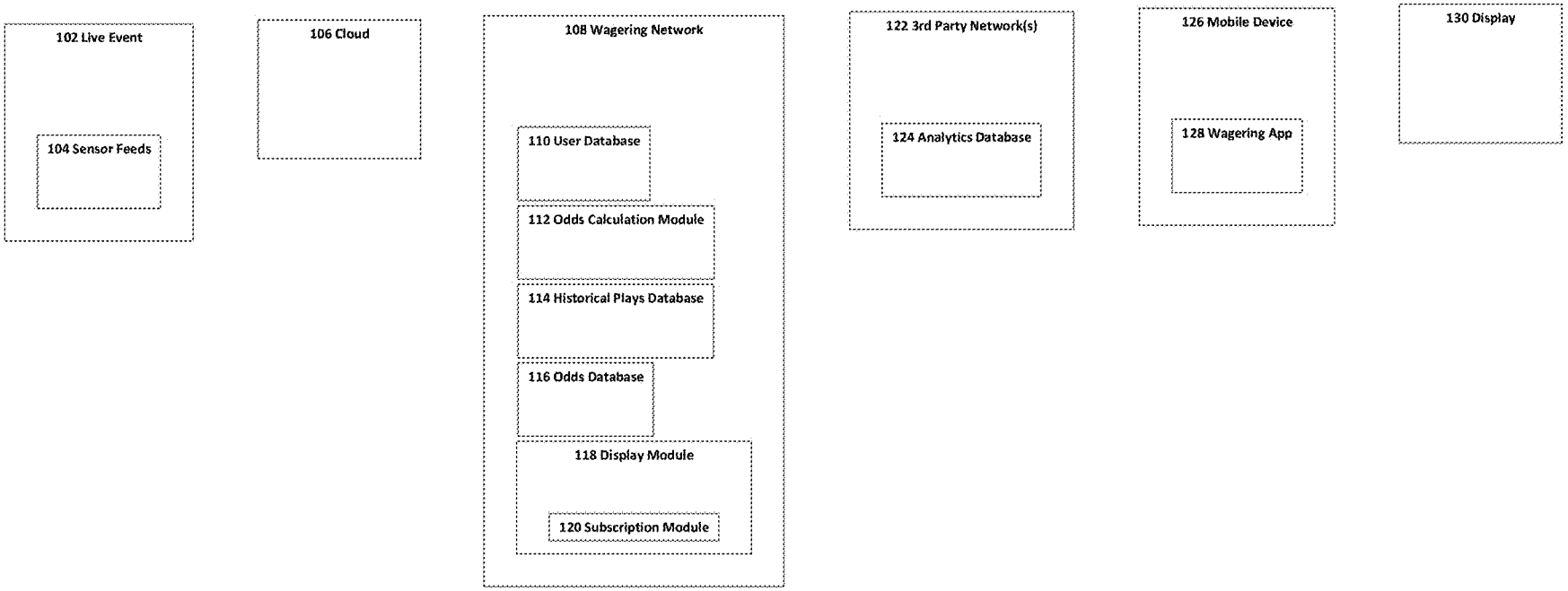
Fig.1 Content - High Level

| | | | | | Available Subscriptions | | |
|---|---|---|---|---|---|---|---|
| User ID | Device ID | Wager History | Wallet Balance | Display Preferences | Analytics Service 1 | Analytics Service 2 | Analytics Service 3 |
| Joe Smith | 1234 | JSWH.dat | $500 | Analytics 1/Player Overlay | X | | |
| Robert Jones | 2345 | RJWH.dat | $1,250 | Analytics 2/Bottom Ribbon | | X | |
| Susan Rice | 3456 | SRWH.dat | $10 | Analytics 3/Player Overlay<br>Analytics 2/Top Ribbon | | X | X |
| | ... | | | | | | |
| Mike Baker | 8791 | MBWH.dat | $200 | No overlay | X | X | X |

Fig.2 User Database Data Content

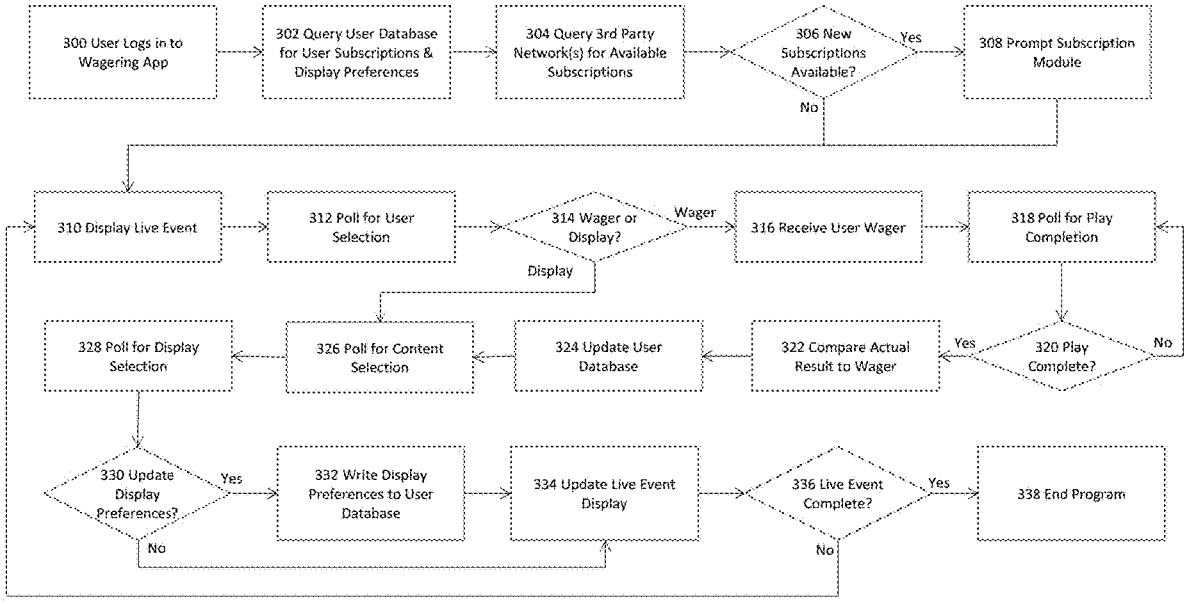

Fig.3 Display Module Object Content

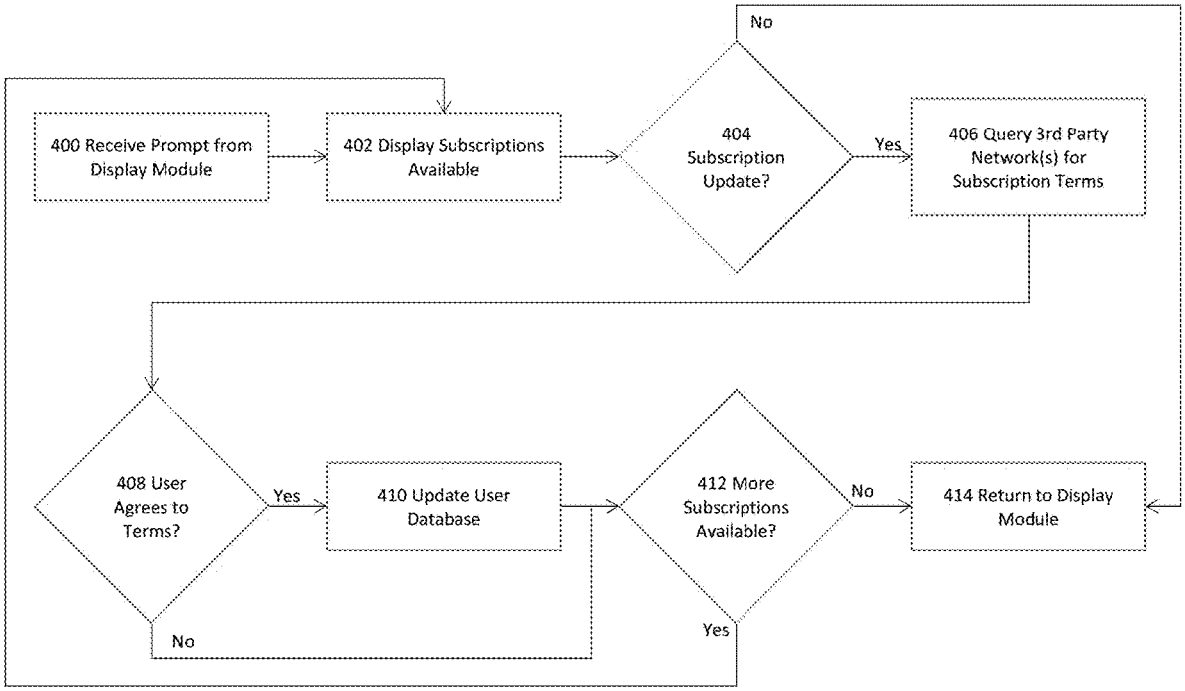
Fig.4 Subscription Module Object Content

METHOD OF USING PLAYER THIRD PARTY DATA

CROSS-REFERENCE TO RELATED APPLICATIONS

The present patent application claims benefit and priority to U.S. Provisional Patent Application No. 63/081,553 entitled "METHOD OF USING PLAYER THIRD PARTY DATA INTEGRATED WITH PLAYER SENSOR DATA" filed on Sep. 22, 2020 which is hereby incorporated by reference into the present disclosure.

FIELD

The embodiments are generally related to integrating third party analytical data into in-play sports wagering platforms.

BACKGROUND

Current sports betting platforms provide numerous different ways to wager on entire sporting events, or individual aspects or portions of those events. The number of these options continues to increase making it difficult for a user to know how best wager on sports. Being overwhelmed with options can lead to users making poor bets and becoming discouraged with the process.

Data analytics, including both statistics and calculated or processed analytics data, has become a mainstay in professional sports, not just with teams evaluating and training their players, but with broadcasters and content creators communicating the nuances of sports to their users. With so much data available, it is hard for fans to know what data to look at when.

When wagering on a sporting event or portion of a sporting event, it is important to have the information a user relies upon to make their decisions readily available. There is simply too much information to be able to fit all the relevant data on the screen with the sporting event.

BRIEF DESCRIPTIONS OF THE DRAWINGS

The accompanying drawings illustrate various embodiments of systems, methods, and various other aspects of the embodiments. Any person with ordinary skills in the art will appreciate that the illustrated element boundaries (e.g. boxes, groups of boxes, or other shapes) in the figures represent an example of the boundaries. It may be understood that, in some examples, one element may be designed as multiple elements or that multiple elements may be designed as one element. In some examples, an element shown as an internal component of one element may be implemented as an external component in another, and vice versa. Furthermore, elements may not be drawn to scale. Non-limiting and non-exhaustive descriptions are described with reference to the following drawings. The components in the figures are not necessarily to scale, emphasis instead being placed upon illustrating principles.

FIG. 1 illustrates a third party analytics integration into a wagering platform, according to an embodiment.

FIG. 2 illustrates a user database, according to an embodiment.

FIG. 3 illustrates a display module, according to an embodiment.

FIG. 4 illustrates a subscription module, according to an embodiment.

DETAILED DESCRIPTION

Aspects of the present invention are disclosed in the following description and related figures directed to specific embodiments of the invention. Those of ordinary skill in the art will recognize that alternate embodiments may be devised without departing from the spirit or the scope of the claims. Additionally, well-known elements of exemplary embodiments of the invention will not be described in detail or will be omitted so as not to obscure the relevant details of the invention As used herein, the word exemplary means serving as an example, instance or illustration. The embodiments described herein are not limiting, but rather are exemplary only. It should be understood that the described embodiments are not necessarily to be construed as preferred or advantageous over other embodiments. Moreover, the terms embodiments of the invention, embodiments or invention do not require that all embodiments of the invention include the discussed feature, advantage, or mode of operation.

Further, many of the embodiments described herein are described in terms of sequences of actions to be performed by, for example, elements of a computing device. It should be recognized by those skilled in the art that the various sequence of actions described herein can be performed by specific circuits (e.g., application specific integrated circuits (ASICs)) and/or by program instructions executed by at least one processor. Additionally, the sequence of actions described herein can be embodied entirely within any form of computer-readable storage medium such that execution of the sequence of actions enables the processor to perform the functionality described herein. Thus, the various aspects of the present invention may be embodied in a number of different forms, all of which have been contemplated to be within the scope of the claimed subject matter. In addition, for each of the embodiments described herein, the corresponding form of any such embodiments may be described herein as, for example, a computer configured to perform the described action.

With respect to the embodiments, a summary of terminology used herein is provided.

An action refers to a specific play or specific movement in a sporting event. For example, an action may determine which players were involved during a sporting event. In some embodiments, an action may be a throw, shot, pass, swing, kick, hit, performed by a participant in a sporting event. In some embodiments, an action may be a strategic decision made by a participant in the sporting event such as a player, coach, management, etc. In some embodiments, an action may be a penalty, foul, or type of infraction occurring in a sporting event. In some embodiments, an action may include the participants of the sporting event. In some embodiments, an action may include beginning events of sporting event, for example opening tips, coin flips, opening pitch, national anthem singers, etc. In some embodiments, a sporting event may be football, hockey, basketball, baseball, golf, tennis, soccer, cricket, rugby, MMA, boxing, swimming, skiing, snowboarding, horse racing, car racing, boat racing, cycling, wrestling, Olympic sport, eSports, etc. Actions can be integrated into the embodiments in a variety of manners.

A "bet" or "wager" is to risk something, usually a sum of money, against someone else's or an entity on the basis of the outcome of a future event, such as the results of a game or event. It may be understood that non-monetary items may be the subject of a "bet" or "wager" as well, such as points or anything else that can be quantified for a "wager" or "bet." A bettor refers to a person who bets or wagers. A bettor may also be referred to as a user, client, or participant throughout the present invention. A "bet" or "wager" could be made for obtaining or risking a coupon or some enhancements to the sporting event, such as better seats, VIP treatment, etc. A "bet" or "wager" can be done for certain amount or for a future time. A "bet" or "wager" can be done for being able to answer a question correctly. A "bet" or "wager" can be done within a certain period of time. A "bet" or "wager" can be integrated into the embodiments in a variety of manners.

A "book" or "sportsbook" refers to a physical establishment that accepts bets on the outcome of sporting events. A "book" or "sportsbook" system enables a human working with a computer to interact, according to set of both implicit and explicit rules, in an electronically powered domain for the purpose of placing bets on the outcome of sporting event. An added game refers to an event not part of the typical menu of wagering offerings, often posted as an accommodation to patrons. A "book" or "sportsbook" can be integrated into the embodiments in a variety of manners.

To "buy points" means a player pays an additional price (more money) to receive a half-point or more in the player's favor on a point spread game. Buying points means you can move a point spread, for example up to two points in your favor. "Buy points" can be integrated into the embodiments in a variety of manners.

The "price" refers to the odds or point spread of an event. To "take the price" means betting the underdog and receiving its advantage in the point spread. "Price" can be integrated into the embodiments in a variety of manners.

"No action" means a wager in which no money is lost or won, and the original bet amount is refunded. "No action" can be integrated into the embodiments in a variety of manners.

The "sides" are the two teams or individuals participating in an event: the underdog and the favorite. The term "favorite" refers to the team considered most likely to win an event or game. The "chalk" refers to a favorite, usually a heavy favorite. Bettors who like to bet big favorites are referred to "chalk eaters" (often a derogatory term). An event or game in which the sports book has reduced its betting limits, usually because of weather or the uncertain status of injured players is referred to as a "circled game." "Laying the points or price" means betting the favorite by giving up points. The term "dog" or "underdog" refers to the team perceived to be most likely to lose an event or game. A "longshot" also refers to a team perceived to be unlikely to win an event or game. "Sides", "favorite", "chalk", "circled game", "laying the points price", "dog" and "underdog" can be integrated into the embodiments in a variety of manners.

The "money line" refers to the odds expressed in terms of money. With money odds, whenever there is a minus (−) the player "lays" or is "laying" that amount to win (for example $100); where there is a plus (+) the player wins that amount for every $100 wagered. A "straight bet" refers to an individual wager on a game or event that will be determined by a point spread or money line. The term "straight-up" means winning the game without any regard to the "point spread"; a "money-line" bet. "Money line", "straight bet", "straight-up" can be integrated into the embodiments in a variety of manners.

The "line" refers to the current odds or point spread on a particular event or game. The "point spread" refers to the margin of points in which the favored team must win an event by to "cover the spread." To "cover" means winning by more than the "point spread". A handicap of the "point spread" value is given to the favorite team so bettors can choose sides at equal odds. "Cover the spread" means that a favorite win an event with the handicap considered or the underdog wins with additional points. To "push" refers to when the event or game ends with no winner or loser for wagering purposes, a tie for wagering purposes. A "tie" is a wager in which no money is lost or won because the teams' scores were equal to the number of points in the given "point spread". The "opening line" means the earliest line posted for a particular sporting event or game. The term "pick" or "pick 'em" refers to a game when neither team is favored in an event or game. "Line", "cover the spread", "cover", "tie", "pick" and "pick-em" can be integrated into the embodiments in a variety of manners.

To "middle" means to win both sides of a game; wagering on the "underdog" at one point spread and the favorite at a different point spread and winning both sides. For example, if the player bets the underdog +4½ and the favorite −3½ and the favorite wins by 4, the player has middled the book and won both bets. "Middle" can be integrated into the embodiments in a variety of manners.

Digital gaming refers to any type of electronic environment that can be controlled or manipulated by a human user for entertainment purposes. A system that enables a human and a computer to interact according to set of both implicit and explicit rules, in an electronically powered domain for the purpose of recreation or instruction. "eSports" refers to a form of sports competition using video games, or a multiplayer video game played competitively for spectators, typically by professional gamers. Digital gaming and "eSports" can be integrated into the embodiments in a variety of manners.

The term event refers to a form of play, sport, contest, or game, especially one played according to rules and decided by skill, strength, or luck. In some embodiments, an event may be football, hockey, basketball, baseball, golf, tennis, soccer, cricket, rugby, MMA, boxing, swimming, skiing, snowboarding, horse racing, car racing, boat racing, cycling, wrestling, Olympic sport, etc. Event can be integrated into the embodiments in a variety of manners.

The "total" is the combined number of runs, points or goals scored by both teams during the game, including overtime. The "over" refers to a sports bet in which the player wagers that the combined point total of two teams will be more than a specified total. The "under" refers to bets that the total points scored by two teams will be less than a certain figure. "Total", "over", and "under" can be integrated into the embodiments in a variety of manners.

A "parlay" is a single bet that links together two or more wagers; to win the bet, the player must win all the wagers in the "parlay". If the player loses one wager, the player loses the entire bet. However, if he wins all the wagers in the "parlay", the player wins a higher payoff than if the player had placed the bets separately. A "round robin" is a series of parlays. A "teaser" is a type of parlay in which the point spread, or total of each individual play is adjusted. The price of moving the point spread (teasing) is lower payoff odds on winning wagers. "Parlay", "round robin", "teaser" can be integrated into the embodiments in a variety of manners.

A "prop bet" or "proposition bet" means a bet that focuses on the outcome of events within a given game. Props are often offered on marquee games of great interest. These include Sunday and Monday night pro football games, various high-profile college football games, major college bowl games and playoff and championship games. An example of a prop bet is "Which team will score the first touchdown?" "Prop bet" or "proposition bet" can be integrated into the embodiments in a variety of manners.

A "first-half bet" refers to a bet placed on the score in the first half of the event only and only considers the first half of the game or event. The process in which you go about placing this bet is the same process that you would use to place a full game bet, but as previously mentioned, only the first half is important to a first-half bet type of wager. A "half-time bet" refers to a bet placed on scoring in the second half of a game or event only. "First-half-bet" and "half-time-bet" can be integrated into the embodiments in a variety of manners.

A "futures bet" or "future" refers to the odds that are posted well in advance on the winner of major events, typical future bets are the Pro Football Championship, Collegiate Football Championship, the Pro Basketball Championship, the Collegiate Basketball Championship, and the Pro Baseball Championship. "Futures bet" or "future" can be integrated into the embodiments in a variety of manners.

The "listed pitchers" is specific to a baseball bet placed only if both of the pitchers scheduled to start a game actually start. If they don't, the bet is deemed "no action" and refunded. The "run line" in baseball, refers to a spread used instead of the money line. "Listed pitchers" and "no action" and "run line" can be integrated into the embodiments in a variety of manners.

The term "handle" refers to the total amount of bets taken. The term "hold" refers to the percentage the house wins. The term "juice" refers to the bookmaker's commission, most commonly the 11 to 10 bettors lay on straight point spread wagers: also known as "vigorish" or "vig". The "limit" refers to the maximum amount accepted by the house before the odds and/or point spread are changed. "Off the board" refers to a game in which no bets are being accepted. "Handle", "juice", vigorish", "vig" and "off the board" can be integrated into the embodiments in a variety of manners.

"Casinos" are a public room or building where gambling games are played. "Racino" is a building complex or grounds having a racetrack and gambling facilities for playing slot machines, blackjack, roulette, etc. "Casino" and "Racino" can be integrated into the embodiments in a variety of manners.

Customers are companies, organizations or individual that would deploy, for fees, and may be part of, of perform, various system elements or method steps in the embodiments.

Managed service user interface service is a service that can help customers (1) manage third parties, (2) develop the web, (3) do data analytics, (4) connect thru application program interfaces and (4) track and report on player behaviors. A managed service user interface can be integrated into the embodiments in a variety of manners.

Managed service risk management services are a service that assists customers with (1) very important person management, (2) business intelligence, and (3) reporting. These managed service risk management services can be integrated into the embodiments in a variety of manners.

Managed service compliance service is a service that helps customers manage (1) integrity monitoring, (2) play safety, (3) responsible gambling and (4) customer service assistance. These managed service compliance services can be integrated into the embodiments in a variety of manners.

Managed service pricing and trading service is a service that helps customers with (1) official data feeds, (2) data visualization and (3) land based, on property digital signage. These managed service pricing and trading services can be integrated into the embodiments in a variety of manners.

Managed service and technology platform are services that helps customers with (1) web hosting, (2) IT support and (3) player account platform support. These managed service and technology platform services can be integrated into the embodiments in a variety of manners.

Managed service and marketing support services are services that help customers (1) acquire and retain clients and users, (2) provide for bonusing options and (3) develop press release content generation. These managed service and marketing support services can be integrated into the embodiments in a variety of manners.

Payment processing services are those services that help customers that allow for (1) account auditing and (2) withdrawal processing to meet standards for speed and accuracy. Further, these services can provide for integration of global and local payment methods. These payment processing services can be integrated into the embodiments in a variety of manners.

Engaging promotions allow customers to treat your players to free bets, odds boosts, enhanced access and flexible cashback to boost lifetime value. Engaging promotions can be integrated into the embodiments in a variety of manners.

"Cash out" or "pay out" or "payout" allow customers to make available, on singles bets or accumulated bets with a partial cash out where each operator can control payouts by managing commission and availability at all times. The "cash out" or "pay out" or "payout" can be integrated into the embodiments in a variety of manners, including both monetary and non-monetary payouts, such as points, prizes, promotional or discount codes, and the like.

"Customized betting" allow customers to have tailored personalized betting experiences with sophisticated tracking and analysis of players' behavior. "Customized betting" can be integrated into the embodiments in a variety of manners.

Kiosks are devices that offer interactions with customers clients and users with a wide range of modular solutions for both retail and online sports gaming. Kiosks can be integrated into the embodiments in a variety of manners.

Business Applications are an integrated suite of tools for customers to manage the everyday activities that drive sales, profit, and growth, from creating and delivering actionable insights on performance to help customers to manage the sports gaming. Business Applications can be integrated into the embodiments in a variety of manners.

State based integration allows for a given sports gambling game to be modified by states in the United States or countries, based upon the state the player is in, based upon mobile phone or other geolocation identification means. State based integration can be integrated into the embodiments in a variety of manners.

Game Configurator allow for configuration of customer operators to have the opportunity to apply various chosen or newly created business rules on the game as well as to parametrize risk management. Game configurator can be integrated into the embodiments in a variety of manners.

"Fantasy sports connector" are software connectors between method steps or system elements in the embodiments that can integrate fantasy sports. Fantasy sports allow a competition in which participants select imaginary teams from among the players in a league and score points according to the actual performance of their players. For example, if a player in a fantasy sports is playing at a given real time sports, odds could be changed in the real time sports for that player.

Software as a service (or SaaS) is a method of software delivery and licensing in which software is accessed online via a subscription, rather than bought and installed on individual computers. Software as a service can be integrated into the embodiments in a variety of manners.

Synchronization of screens means synchronizing bets and results between devices, such as TV and mobile, PC and wearables. Synchronization of screens can be integrated into the embodiments in a variety of manners.

Automatic content recognition (ACR) is an identification technology to recognize content played on a media device or present in a media file. Devices containing ACR support enable users to quickly obtain additional information about the content they see without any user-based input or search efforts. To start the recognition, a short media clip (audio, video, or both) is selected. This clip could be selected from within a media file or recorded by a device. Through algorithms such as fingerprinting, information from the actual perceptual content is taken and compared to a database of reference fingerprints, each reference fingerprint corresponding to a known recorded work. A database may contain metadata about the work and associated information, including complementary media. If the fingerprint of the media clip is matched, the identification software returns the corresponding metadata to the client application. For example, during an in-play sports game a "fumble" could be recognized and at the time stamp of the event, metadata such as "fumble" could be displayed. Automatic content recognition (ACR) can be integrated into the embodiments in a variety of manners.

Joining social media means connecting an in-play sports game bet or result to a social media connection, such as a FACEBOOK® chat interaction. Joining social media can be integrated into the embodiments in a variety of manners.

Augmented reality means a technology that superimposes a computer-generated image on a user's view of the real world, thus providing a composite view. In an example of this invention, a real time view of the game can be seen and a "bet" which is a computer-generated data point is placed above the player that is bet on. Augmented reality can be integrated into the embodiments in a variety of manners.

Some embodiments of this disclosure, illustrating all its features, will now be discussed in detail. It can be understood that the embodiments are intended to be open ended in that an item or items used in the embodiments is not meant to be an exhaustive listing of such item or items, or meant to be limited to only the listed item or items.

It can be noted that as used herein and in the appended claims, the singular forms "a," "an," and "the" include plural references unless the context clearly dictates otherwise. Although any systems and methods similar or equivalent to those described herein can be used in the practice or testing of embodiments, only some exemplary systems and methods are now described.

FIG. 1 is a system for a third party analytics integration into a wagering platform. The system may include a live event 102, for example a sporting event such as a football game, basketball game, baseball game, hockey game, tennis match, golf tournament, eSports or digital game, etc. The live event will include some number of actions or plays, upon with a user or bettor or customer can place a bet or wager, typically through an entity called a sportsbook. There are numerous types of wagers the bettor can make, including, a straight bet, a money line bet, a bet with a point spread or line that bettor's team would need to cover, if the result of the game with the same as the point spread the user would not cover the spread, but instead the tie is called a push. If the user is betting on the favorite, they are giving points to the opposing side, which is the underdog or longshot. Betting on all favorites is referred to as chalk, this is typically applied to round robin, or other styles of tournaments. There are other types of wagers, including parlays, teasers, and prop bets, that are added games, that often allow the user to customize their betting, by changing the odds and payouts they receive on a wager. Certain sportsbooks will allow the bettor to buy points, to move the point spread off of the opening line, this will increase the price of the bet, sometimes by increasing the juice, vig, or hold that the sportsbook takes. Another type of wager the bettor can make is an over/under, in which the user bets over or under a total for the live event, such as the score of American football or the run line in baseball, or a series of action in the live event. Sportsbooks have a number of bets they can handle, a limit of wagers they can take on either side of a bet before they will move the line or odds off of the opening line. Additionally, there are circumstance, such as an injury to an important player such as a listed pitcher, in which a sportsbook, casino or racino will take an available wager off the board. As the line moves there becomes an opportunity for a bettor to bet on both sides at different point spreads in order to middle and win both bets. Sportsbooks will often offer bets on portions of games, such as first half bets and half-time bets. Additionally, the sportsbook can offer futures bets on live events in the future. Sportsbooks need to offer payment processing services in order to cash out customers. This can be done at kiosks at the live event or at another location.

Further, embodiments may include a plurality of sensors 104 that may be used such as motion sensors, temperature sensors, humidity sensors, cameras such as an RGB-D Camera which is a digital camera capture color (RGB) and depth information for every pixel in an image, microphones, radiofrequency receiver, a thermal imager, a radar device, a lidar device, an ultrasound device, a speaker, wearable devices etc. Also, the plurality of sensors may include tracking devices, such as RFID tags, GPS chips or other such devices embedded on uniforms, in equipment, in the field of play, in the boundaries of the field of play, or other markers on the field of play. Imaging devices may also be used as tracking devices such as player tracking that captures statistical information through real-time X, Y positioning of players and X, Y, Z positioning of the ball. In this embodiment only the video feed is used, but in other embodiments additional sensor data can be used to augment the accuracy of the probabilistic engine.

Further, embodiments may include a cloud 106 or communication network that may be a wired and/or a wireless network. The communication network, if wireless, may be implemented using communication techniques such as Visible Light Communication (VLC), Worldwide Interoperability for Microwave Access (WiMAX), Long Term Evolution (LTE), Wireless Local Area Network (WLAN), Infrared (IR) communication, Public Switched Telephone Network (PSTN), Radio waves, and other communication techniques known in the art. The communication network may allow ubiquitous access to shared pools of configurable resources and higher-level services that can be rapidly provisioned with minimal management effort, often over the Internet and relies on sharing of resources to achieve coherence and economies of scale, like a public utility, while third-party clouds enable organizations to focus on their core businesses instead of expending resources on computer infrastructure and maintenance. The cloud may be communicatively coupled to wagering network 108 which may perform real time analysis on the type of play and the result of the play. The cloud may also be synchronized with game situational data, such as the time of the game, the score, location on the field, weather conditions, and the like which may affect the choice of play utilized. For example, in other exemplary embodiments, the cloud may not receive data gathered from sensors and may, instead, receive data from an alternative data feed, such as SportsRadar®. This data may be compiled substantially immediately following the completion of any play and the data from this feed may be compared with a variety of team data and league data based on a variety of elements, including down, possession, score, time, team, and so forth, as described in various exemplary embodiments herein.

Further, embodiments may include a wagering network 108 which may perform real time analysis on the type of play and the result of a play or action. The wagering network 108 (or cloud 106) may also be synchronized with game situational data, such as the time of the game, the score, location on the field, weather conditions, and the like which may affect the choice of play utilized. For example, in other exemplary embodiments, wagering network 108 may not receive data gathered from sensors and may, instead, receive data from an alternative data feed, such as SportsRadar®. This data may be compiled substantially immediately following the completion of any play and the data from this feed may be compared with a variety of team data and league data based on a variety of elements, including down, possession, score, time, team, and so forth, as described in various exemplary embodiments herein. The wagering network can offer a number of software as a service managed services such as, user interface service, risk management service, compliance, pricing and trading service, IT support of the technology platform, business applications, game configuration, state based integration, fantasy sports connection, integration to allow the joining of social media, as well as marketing support services that can provide engaging promotions to the user.

Further, embodiments may include a user database 110 which contains data relevant to all users of the wagering network 108, which may include, a user ID of the user, a device identifier, a paired device identifier, wagering history, wallet information for the user, the user's selected display settings, and the subscriptions to third party network(s) 122 the user has subscribed to.

Further, embodiments may include an odds calculation module 112 which utilizes historical play data, as well as the third party network's 122 analytics, to calculate odds for in-play wagers. Further, it may be understood that any third party analytics or analytics data can include both statistics and calculated or processed analytics data. Thus, in different embodiments, one or both of statistical information from the third party and analytics from the third party may be utilized.

Further, embodiments may include a historical plays database 114, that contains play data for the type of sport being played in live event 102. For example, in American football, for optimal odds calculation, the historical play data should include meta data about the historical plays, such as time, location, weather, previous plays, opponent, physiological data, etc.

Further, embodiments may include an odds database 116 that contains the odds calculated by the odds calculation module, and is used for reference by the path wagering module 122 to display the odds on either the user's mobile device 126 or a secondary display 130, and to take bets from the user through the mobile device wagering app 128.

Further, embodiments may include a display module 118 that coordinates what is shown on the mobile device 126 through the wagering app 128. The live event and available bettors are displayed on the mobile device 126 according to the user's preferences which are stored in the user database 110. When a user begins to watch a live event 102 through the wagering app 128, the user can access third party network analytics. If the user elects to or has already subscribed to at least one third party network the third party network(s) 122 are polled for available analytics subscriptions, the available subscriptions are compared to the user's subscriptions in the user database 110. The mobile device is polled for user to select either to adjust the display or to place a wager. When the user selects a display adjustment, the analytics data types available from the third party network(s) 122 that the user has subscribed to are made available, such as various statistics, analyzed data, and the like. The user selects the data type(s) they wish to overlay on the live event 102 on the display 130. The user can continue to adjust what analytics are overlaid until the live event 102 ends, or they elect to place a wager. When a wager is placed the live event is monitored for the end of the play, the results of the play are then compared to the wager, and the user's account balance/wallet information is adjusted based on the wager result is recorded in the user database 112. The user can continue to adjust the analytics display and place wagers from play to play through the display module.

Further, embodiments may include a subscription module 120 that allows the user to view analytics available from third party network(s) 122 to be integrated with their wagering display. The user will then be able to subscribe to the third party network(s) 122 that deliver the most value to their wagering experience.

Further, embodiments may include at least one third party network 122 that provides analytics about the live event being wagered upon. For example, SportsRadar provides an API into its database of statistics and analytics for the NFL, NBA, NHL, MLB®, ESL and NASCAR. They compile live wagering odds services in addition to the historical play data from that sport. Companies such as Stats Perform, as utilizing artificial intelligence to analyze ball and player movement data to make in game predictions. These types of third party data sources will be utilized in the calculation of odds. In some embodiments the odds calculation module 112 is outsourced entirely to a third party network 122 that delivers odds making services, such as SportsRadar or Stats Perform. Users can subscribe to varying levels of access to statistics and analytics data through the third party network(s).

Further, embodiments may utilize at least one analytics database 124 associated with at least one third party network 122. Each third party network 122 connected to the wagering network 108 will have at least one analytics database 124. It may be understood that any analytics database 124 could include any of a variety of data or information, including various statistics, data types, analytics derived from different methodologies, data types, etc. In this example there is just one third party network that stores both their analytics as well as the data that is derived from in one database. However, each third party network 122 could have a number of different databases for different sports, data types, analytics methods, statistics, etc.

Further, embodiments may include a mobile device 126, such as a computing device, laptop, smartphone, tablet, computer, smart speaker, or I/O devices. Input devices may include keyboards, mice, trackpads, trackballs, touchpads, touch mice, multi-touch touchpads and touch mice, microphones, multi-array microphones, drawing tablets, cameras, single-lens reflex camera (SLR), digital SLR (DSLR), CMOS sensors, accelerometers, infrared optical sensors, pressure sensors, magnetometer sensors, angular rate sensors, depth sensors, proximity sensors, ambient light sensors, gyroscopic sensors, or other sensors. Output devices may include video displays, graphical displays, speakers, headphones, inkjet printers, laser printers, and 3D printers. Devices may include a combination of multiple input or output devices, including, e.g., Microsoft KINECT, Nintendo Wii mote for the WIT, Nintendo WII U GAMEPAD, or Apple IPHONE. Some devices allow gesture recognition inputs through combining some of the inputs and outputs. Some devices allow for facial recognition which may be utilized as an input for different purposes including authentication and other commands. Some devices allow for voice recognition and inputs, including, e.g., Microsoft KINECT, SIRI for IPHONE by Apple, Google Now or Google Voice Search. Additional user devices have both input and output capabilities, including, e.g., haptic feedback devices, touchscreen displays, or multi-touch displays. Touchscreen, multi-touch displays, touchpads, touch mice, or other touch sensing devices may use different technologies to sense touch, including, e.g., capacitive, surface capacitive, projected capacitive touch (PCT), in-cell capacitive, resistive, infrared, waveguide, dispersive signal touch (DST), in-cell optical, surface acoustic wave (SAW), bending wave touch (BWT), or force-based sensing technologies. Some multi-touch devices may allow two or more contact points with the surface, allowing advanced functionality including, e.g., pinch, spread, rotate, scroll, or other gestures. Some touchscreen devices, including, e.g., Microsoft PIXELSENSE or Multi-Touch Collaboration Wall, may have larger surfaces, such as on a table-top or on a wall, and may also interact with other electronic devices. Some I/O devices, display devices or group of devices may be augmented reality devices. The I/O devices may be controlled by an I/O controller. The I/O controller may control one or more I/O devices, such as, e.g., a keyboard and a pointing device, e.g., a mouse or optical pen. Furthermore, an I/O device may also have storage and/or an installation medium for the computing device. In still other embodiments, the computing device may have USB connections (not shown) to receive handheld USB storage devices. In further embodiments, an I/O device may be a bridge between the system bus and an external communication bus, e.g. a USB bus, a SCSI bus, a FireWire bus, an Ethernet bus, a Gigabit Ethernet bus, a Fiber Channel bus, or a Thunderbolt bus. In some embodiments the user device could be an optional component and would be utilized in a situation in which the paired wearable device is utilizing the user device as additional memory or computing power or connection to the internet.

Further, embodiments may include a wagering app 128, which is a program that enables the user to place bets on individual plays in the live event 102, and display the audio and video from the live event 102, along with the available wagers, and statistical and analytical overlays on either the user's mobile device 126 or their display 130. The wagering app 128 allows the user to interact with the wagering network in order to place bets and allow for the payment/receipt funds based on wager outcomes.

Further, embodiments may include a display 130, such as a television, smartphone, tablet, gaming console, etc., on which the live event 102, along with the available wagers, and path overlays can be displayed on instead of, or in addition to being displayed on the mobile device 126.

FIG. 2 illustrates the user database 110. The database contains information about all of the users of the wagering network 108. This information includes, but is not limited to, a user identification, which is the user's name in this example but could also be any other kind of alphanumeric identification. A device identification, for the mobile device 126 on which the wagering app 128 is installed. The user's wager history, which is a data file in this example. The user's current wallet/account balance, in this example the balance is in US dollars, but other currencies or non-monetary prizes such as points could be used. The user's display preferences, such as a particular analytics dataset, or statistic inside of that dataset, and how it is displayed in relation to the live event 102, such as the player's heartrate being overlaid above the player's head, or their top sprint speed in a ribbon along the bottom of the display 130. The third party network(s) 122, and which analytics database(s) 124 the user is subscribed to.

FIG. 3 illustrates the display module 118. The module begins with the user logging into the wagering app 128 on their mobile device 126, at step 300. The user database 110 is then queried, at step 302, for which third party network(s) 122 and/or analytics database(s) 124 the user has already subscribed to. The third party network(s) are then queried, at step 304, for available analytics database(s) 124 that are available to be subscribed to. It is then determined, at step 306 if there are any analytics database(s) 124 that the user has not yet subscribed to. If there are no analytics database(s) 124 that the user has not yet subscribed to, the module proceeds to step 310. In this example the user Joe Smith is not yet subscribed to an analytics database(s) 124. If there is at least one analytics database 124 available to subscribe to that the user is not already subscribed to, the subscription module 120 is prompted, at step 308. The live event 102 is then displayed, at step 310, on either the user's mobile device 126 or the display 130. In this embodiment the user Joe Smith is controlling the display 130, which is the user's television, with their mobile device 126, and is watching the live event 102 which is an American football game between the Green Bay Packers and the Chicago Bears at Soldier Field in Chicago. The wagering app 128 is then polled, at step 312 for a user selection of either making a wager or adjusting the display of at least one of the analytics database(s) 124 they have subscribed to. If the user elects, at step 314 to make an adjustment to what live event is displayed, what analytics are displayed, or how they are displayed, the module proceeds to step 326. In this example, the user Joe Smith elects to display the information in the analytics database 124 that is relevant to the players currently on the field. If the user elects, at step 314 to place a wager, the module proceeds to step 316. In this example the user Joe Smith is wagering that Green Bay quarterback number 12 will throw a completed pass for between 7 and 10 yards on the next play, which is a 3rd down with 5 yards to go for a first down on the Chicago 35 yard line with 3:00 minutes to go in the 3rd quarter, with the Bears leading 20-16. The path taken is based on the selection, at step 314, by the user to place a wager or adjust the display of analytics. If the user elects to make a wager, in this example the wager is $100 wagered at +250 odds that Green Bay quarterback number 12 will complete a pass on the next play for between 7 and 10 yards, that wager is received, at step 316 by the module. The live event 102 is monitored, at step 318, for the completion of the play wagered upon by the user. The module will continue to return to step 318 until it determines, at step 320, that the play is complete. For example, by detecting the whistle blown to signify the end of a play in an American football game. The actual result of the play, in this example a pass completed by Green Bay quarterback number 12 for 8 yards, is compared, at step 322, to the wagered upon result. In this example the user Joe Smith won their wager of $100 at +250 odds, so his account balance of $500 will change to you $750, after which the user database 110 is updated, at step 324, to reflect the change in the user's account balance based upon the result of the wager. Once a wager result's impact on a user's account has been recorded, at step 324, in the user database 110, or if the user elected to make a display selection at step 314, the module polls for a content selection, at step 326. A content selection can be either changing the live event 102 being displayed, which analytics database 124 content they wish to display, or how they want that analytics content to be displayed. For example, the user Joe Smith subscribed to Analytics Service 1, which delivers live streams of player physiological data, such as heart and respiration rate, that is captured through a combination of optical sensors and player worn sensors. After selecting this data at step 326, the user must make a display selection, at step 328. In this example the user Joe Smith elects to have the heart rate of each player overlaid on that player's representation. Once the user makes this selection, they module prompts the user, at step 330, to make this their default display preference. If the user elects, at step 330 to not make their current display preference their default display preference, the module proceeds to step 334. If the user elects to make the current display preferences their default display preferences, the new user preferences are written to the user database 110, at step 332. The live event 102 is then displayed, at step 334, on either the user's mobile device 126 or the display 130. In this embodiment the user Joe Smith is controlling the display 130, which is the user's television, with their mobile device 126, along with any analytics data that the user has elected to overlay onto the live event 102 or add as a ribbon along one edge of the display 130. If the live event 102 is not completed, the module returns to step 310. The module determines, at step 336, if the live event 102 is complete, or if the user wants to display a different live event 102. If the live event 102 is complete, or the user logs out of the wagering app 128, the program ends, at step 338.

FIG. 4 illustrates the subscription module 120. The subscription module 120 begins with receiving a prompt, at step 400 from the display module 118 indicating that there is at least one analytics database 124 on at least one third party network 122 that the user has not subscribed to. The analytics database(s) 124 that are available to be subscribed to are displayed, at step 402, on the user's mobile device 126 or the display 130. The module then polls, at step 404, the user device 126 for the user selection to update or not to update their analytics subscriptions. If the user does not want to update their analytics subscriptions, the module proceeds to step 414. If the user elects, at step 404, to make a subscription change the third party network 122 that has the analytics database(s) 124 that the user has elected to subscribe to, is queried, at step 406, for the subscription terms for that analytics database 124. In this example user Joe Smith is electing to subscribe to analytics service 1. The user then decides, at step 408, if they wish to agree to the subscription terms, such as $25 per month, or $5 per game, or $10 per GB of analytics data, etc., for the available analytics database(s) 124. If the user does not agree to the subscription terms, the module proceeds to step 412. If the user does want to subscribe to the analytics database 124 and agrees, at step 408 to the subscription terms, the subscription data in the user database 110 is updated, at step 410 to include the user's new subscription. While this example only demonstrates the addition of new subscriptions, the module could also be used to remove or change existing subscriptions. The module determines, at step 412, if there are subscriptions available that have not yet been offered to the user. If more subscriptions are available, the module returns to step 402. If there are no more subscriptions available, the module returns to the display module 118, at step 414.

The foregoing description and accompanying figures illustrate the principles, preferred embodiments and modes of operation of those embodiments. However, the embodiments should not be construed as being limited to the particular embodiments discussed above. Additional variations of the embodiments discussed above will be appreciated by those skilled in the art.

Therefore, the above-described embodiments should be regarded as illustrative rather than restrictive. Accordingly, it should be appreciated that variations to those embodiments can be made by those skilled in the art without departing from the scope of the invention as defined by the following claims.

What is claimed is:

1. A system to provide at least one set of analytics data to users of gambling games, the system comprising:

a wagering network that hosts in-play wagering on live sporting events;

data received from a live sporting event;

odds generated for single play outcomes for the live sporting event; and a live event integration system;

wherein the system is configured to:

receive, from an end user device, a user login indication;

based on the user login, query a database comprising a set of associations between a plurality of users and each of a plurality of external subscription services, each of the subscription services comprising one or more sports analytics, retrieve, based on the query, a set of subscriptions associated with the user, and identify at least two external subscription services associated with the user;

access the at least two external subscription services associated with the user and retrieving data from each of the at least two external subscription services;

receive, from the end user, data comprising user-specified preferences for display of both analytics data comprising the one or more sports analytics of the each of the subscription services and the odds for single play outcomes on the end user device;

combine and display, on a live event display, in real time, with the live event integration system, a live event data stream and at least one sports analytic in the analytics data, said at least one sports analytic retrieved from at least one of the at least two external subscription services based on data received from the end user device; and monitor the end user device for a wager selection, and, upon receiving the wager selection, monitoring, in real time, a completion status of a play, and stopping monitoring of user input from the end user device until the play is complete.

2. The system of claim 1, further comprising an interface on the end user device for adjusting a display on the end user device.

3. The system of claim 2, wherein the interface provides options for displaying and adjusting the display of each of the live sporting event, the odds for single play outcomes, and analytics data.

4. The system of claim 2, wherein the interface provides options for displaying and adjusting the display of each of the live sporting event, wagers made on single play outcomes, and analytics data.

5. The system of claim 1, wherein the analytics data comprises at least one of sports analytics and sports statistics.

6. The system of claim 1, wherein the system is configured to access the one or more network providers of sports analytics by accessing, with a server of the wagering network, via one or more APIs associated with the one or more network providers of sports analytics, one or more analytics databases.

7. The system of claim 1, wherein the system is further configured to retrieve, from at least one of the network providers of sports analytics, at least one further set of odds generated for single play outcomes for the live sporting event.

8. The system of claim 1, wherein the system is further configured to provide a default display preference, and is further configured to store, as the default display preference, the data of how to display both the analytics data and the odds for single play outcomes on the end user device.

9. The system of claim 1, wherein the system is further configured to receive, from the end user device, further subscription data comprising an additional network, and is configured to incorporate, into the one or more network providers of sports analytics, the additional network.

10. The system of claim 1, wherein the data received from the live sporting event further comprises data from at least one on-field sensor.

11. The system of claim 10, wherein the at least one on-field sensor comprises at least one of a motion sensor, a temperature sensor, a humidity sensor, a camera, a microphone, a radiofrequency receiver, a thermal imager, a radar device, a lidar device, an ultrasound device, or a speaker.

12. The system of claim 10, wherein the at least one on-field sensor comprises a wearable device associated with a particular player.

13. The system of claim 1, wherein the system is configured to combine and display, in real time, a plurality of sports analytics in the analytics data with the live event data stream, each of the plurality of sports analytics retrieved from a different one of the at least two external subscription services.

* * * * *